US006171205B1

(12) United States Patent
Hummel

(10) Patent No.: US 6,171,205 B1
(45) Date of Patent: Jan. 9, 2001

(54) VOLLEYBALL TRAINING DEVICE

(76) Inventor: Larry Hummel, P.O. Box 1791, R.R. #1, Sidney, IA (US) 51652

( * ) Notice: Under 35 U.S.C. 154(b), the term of this patent shall be extended for 0 days.

(21) Appl. No.: 09/249,540

(22) Filed: Feb. 12, 1999

Related U.S. Application Data

(60) Provisional application No. 60/080,998, filed on Apr. 7, 1998.

(51) Int. Cl.[7] ..... A63B 69/00

(52) U.S. Cl. ..... 473/459; 473/462; 473/426; 473/473

(58) Field of Search ..... 473/459, 575, 473/415–430, 462–464; 2/22, 2; D2/27

(56) References Cited

U.S. PATENT DOCUMENTS

| | | | | |
|---|---|---|---|---|
| 3,602,504 | | 8/1971 | Chapman et al. . | |
| 3,897,950 | | 8/1975 | Keller . | |
| 4,022,471 | | 5/1977 | Keller . | |
| 4,372,561 | * | 2/1983 | Morgan et al. | 473/459 |
| 4,842,284 | | 6/1989 | Russhing et al. . | |
| 4,881,742 | | 11/1989 | Hargreave . | |
| 4,887,821 | * | 12/1989 | Greene et al. | 473/459 |
| 5,060,946 | | 10/1991 | Taylor . | |
| 5,062,646 | | 11/1991 | Crist . | |
| 5,238,251 | * | 8/1993 | Staka | 473/429 |
| 5,460,385 | | 10/1995 | Lazzeroni . | |
| 5,470,056 | | 11/1995 | Dennesen . | |
| 5,472,212 | | 12/1995 | Bercaw . | |
| 5,669,834 | * | 9/1997 | Slupskiy | 473/459 |
| 5,692,978 | | 12/1997 | Hummel . | |

OTHER PUBLICATIONS

Volleyball Equipment or the 21st Century.

* cited by examiner

*Primary Examiner*—Jeanette Chapman
*Assistant Examiner*—Mitra Aryanpour
(74) *Attorney, Agent, or Firm*—Suiter & Associates PC

(57) ABSTRACT

A volleyball player training device especially useful for teaching volleyball players to block and tip a volleyball at the volleyball net is disclosed. The device includes a frame which may be removably fastened to the volleyball net, a volleyball, and a pedestal or support extending upwardly from the frame for holding a volleyball above the volleyball net. During use, a player may block or tip the volleyball causing it to be pivoted from its supported position above the net. A return mechanism returns the volleyball to its supported position placing it in position to be blocked or tipped again.

17 Claims, 4 Drawing Sheets

VOLLEYBALL TRAINING DEVICE

CROSS-REFERENCE TO RELATED APPLICATIONS

The present application claims the benefit under 35 U.S.C. § 119(e) of U.S. Provisional Application No. 60/080,998, filed Apr. 7, 1998. Said U.S. Provisional application Ser. No. 60/080,998 is herein incorporated by reference in its entirety.

INCORPORATION BY REFERENCE

The following related commonly owned U.S. patent is incorporated herein by reference in its entirety:

| Applicant | Ser. No. | Filing Date | U.S. Pat. No. | Issue Date |
|---|---|---|---|---|
| Hummel | 08/695,276 | Aug. 5, 1996 | 5,692,978 | Dec. 2, 1997 |

TECHNICAL FIELD

The present invention relates generally to athletic training devices, and more particularly to training devices for developing specific skills in volleyball players.

BACKGROUND OF THE INVENTION

The sport of volleyball originated in the United States around the turn of the century. Since that time, volleyball has experienced tremendous growth in popularity and has become an important part of many collegiate and high school athletic programs as well as an Olympic sport.

A volleyball game is begun by a server hitting or serving a ball over a net to a receiving team. The receiving team then has three contacts to return the ball over the net. These three contacts will usually include a pass to the net area, a set to an attacker, and an attack which usually consists of a spike across the net, the objective being to hit the ball to the floor in the opposing team's court area. The opposing team's first line of defense to the attack is the block. The block may be formed by one, two or three players depending on the situation and the team's strategy. The object of the block is to intercept an attacked ball before, during, or immediately after it crosses the net.

Consequently, an important skill that volleyball players must develop is the ability to target block and tip the volleyball at the net. Thus, volleyball coaches have evolved many practice drills to teach these skills to volleyball players. However, the effectiveness of the drills could be increased dramatically if an effective training aid were developed that would simulate placement of a volleyball above the net so that players may practice target blocking and setters may practice tipping at the net.

SUMMARY OF THE INVENTION

The present invention provides a novel volleyball player training device (block and tip device) especially useful for teaching volleyball players to target block and tip a volleyball at the volleyball net. The training device includes a frame which may be removably attached to the volleyball net by an attachment device, a volleyball, and a support extending upwardly from the frame for supporting the volleyball above the volleyball net. During use, a player may block or tip the volleyball causing it to be pivoted from an upright position wherein it is supported on top of the support to a displaced position at an angle to the support. A return mechanism, which includes a spring attached between the volleyball and the support, returns the volleyball from the displaced position to the upright position placing it in position to be blocked or tipped again.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION

The present invention provides a novel volleyball player training device (block and tip device) especially useful for teaching volleyball players to block and tip a volleyball at the net. The training device includes a frame which may be removably attached to the volleyball net by an attachment device, a volleyball, and a support extending upwardly from the frame for supporting a volleyball above the volleyball net. During use, a player may block or tip the volleyball causing it to be pivoted from an upright position wherein it is supported by the support to a displaced position at an angle to the support. A return mechanism, which may include a spring attached between the volleyball and the support, returns the volleyball from the displaced position to the upright position placing it in position to be blocked or tipped again. Accordingly, reference will now be made in detail to the presently preferred embodiments of the invention, examples of which are illustrated in the accompanying drawings.

Figure 1:
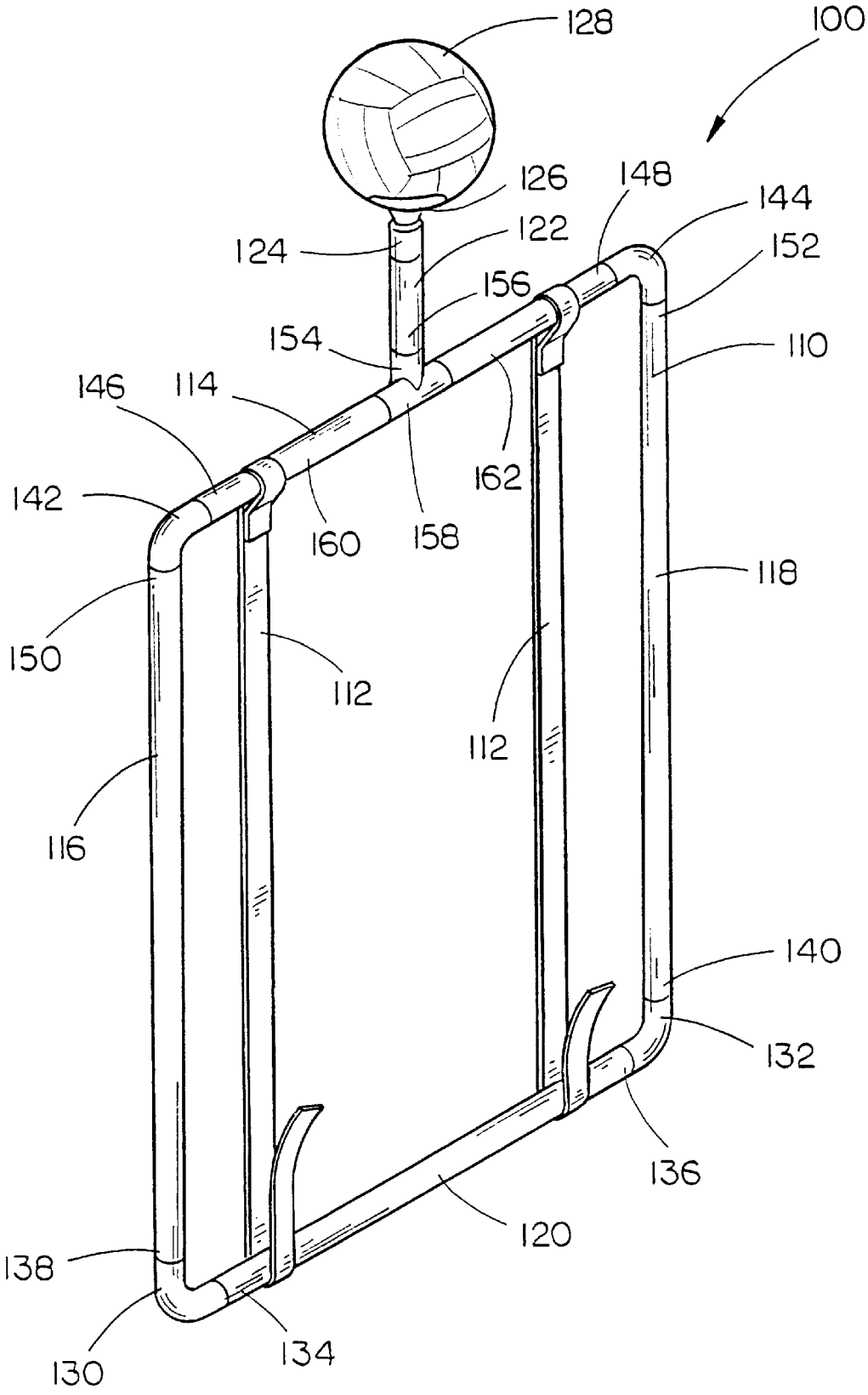
FIG. 1 is an isometric view of a training device according to an exemplary embodiment of the present invention wherein the device includes a single support and volleyball.

Referring now to FIG. 1, a volleyball player training device according to an exemplary embodiment of the present invention is shown wherein the device includes a single support and volleyball. This training device 100 is especially useful for training players to perform a single block or to teach a setter to tip the volleyball at the volleyball net. The training device 100 includes a frame 110 which may be removably attached to the volleyball net by an attachment device 112 comprising a belt which may be wrapped around the upper cable and lower cord of a volleyball net (see FIG.

3). The frame 110 includes an upper frame member 114, first and second side frame members 116 & 118, and a lower frame member 120 joined together so that the periphery of the frame 110 is generally rectangular in shape. Preferably, when the frame 110 is attached to a volleyball net, the upper and lower frame members 114 & 120 are oriented so as to be substantially horizontal to the floor or ground surface of the volleyball court, and the first and second side frame members 116 & 118 are oriented so as to be substantially vertical to the floor or ground surface of the volleyball court. A generally vertical support member 122 may extend upwardly from the center of the upper frame member 114. The support member 122 may include an upper end 124 having a pedestal or cup 126 for supporting a volleyball 128 above the volleyball net.

As shown in FIG. 1, a generally L-shaped corner member 130 & 132 may join an end 134 & 136 of the lower frame member 120 to a lower end 138 & 140 of each side frame member 116 & 118. Similarly, corner members 142 & 144 may join an end 146 & 148 of the upper frame member 114 to an upper end 150 & 152 of each side frame members 116 & 118. A generally T-shaped connecting member 154 may join the lower end 156 of the support member 122 to the center 158 of the upper frame member 114. For example, the upper frame member 114 may be divided into two half members 160 & 162 each having an end 164 & 166 attached to the connecting member 154 and an end 146 & 148 joined to a corner member 142 & 144. Alternatively, the upper frame member 114 may pass through the connecting member 154. According to a preferred method of construction, the frame members 114, 116, 118 & 120, support member 122, corner members 130,132,142 & 144, and connecting member 158 may be made of ¾-inch diameter polyvinyl chloride (PVC) pipe secured together by an adhesive or fasteners such as screws, bolts, friction or interference fit, or the like. Alternatively, however, the entire frame 110 and support member 122 assembly may be of a unitary construction and may be formed of metal, plastic, composite, wood, or the like.

Figure 2:
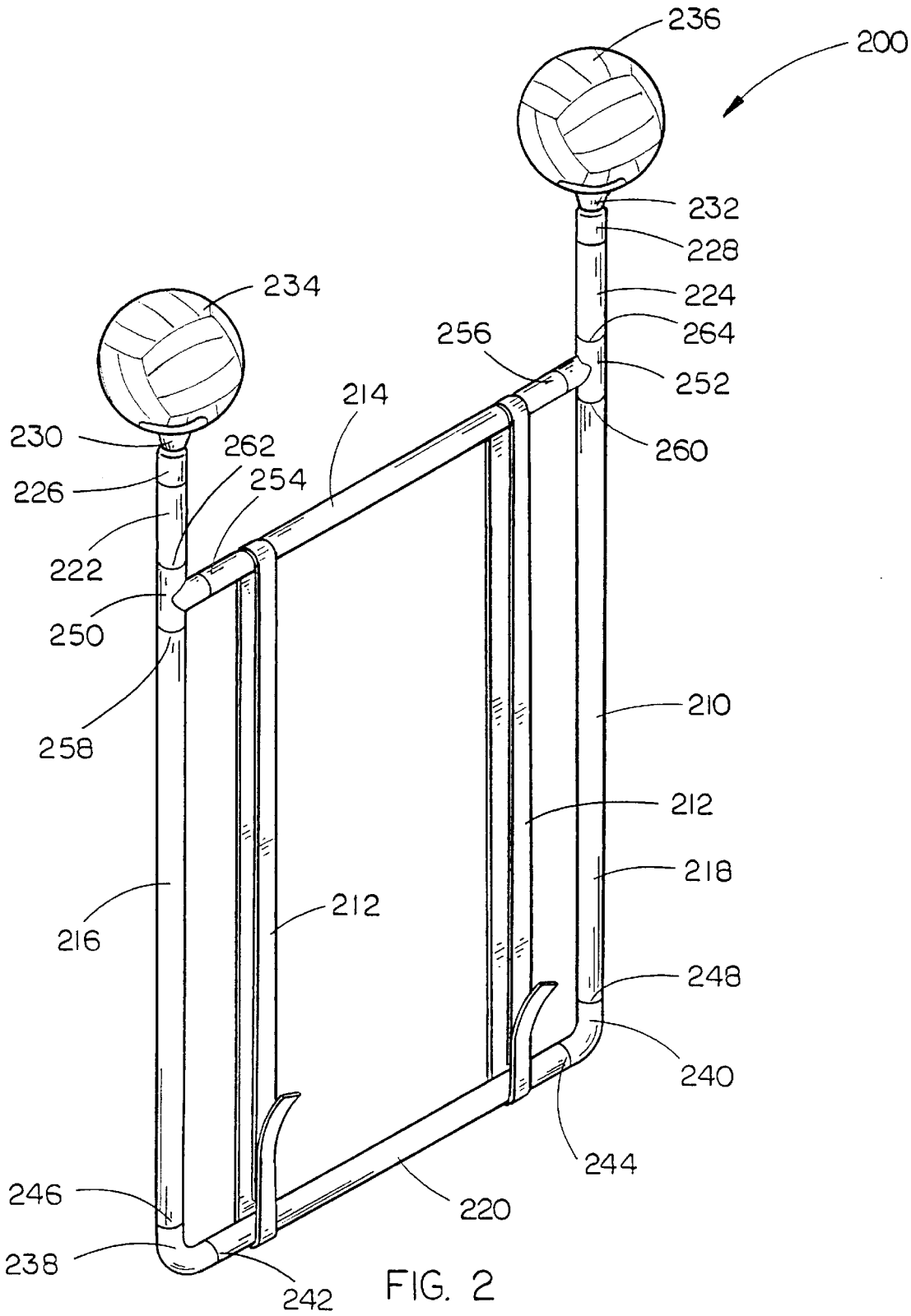
FIG. 2 is an isometric view of a training device according to an exemplary embodiment of the present invention wherein the device includes two supports and volleyballs.

Referring now to FIG. 2, a volleyball player training device is shown wherein the device includes two supports and volleyballs. This training device 200 is especially useful for training players to perform a double block. The training device 200, like the single training device 100 shown in FIG. 1, includes a frame 210 which maybe removably attached to the volleyball net by an attachment device 212. The frame 210 preferably includes an upper frame member 214, first and second side members 216 & 218, and a lower frame member 220 joined together so that the periphery of the frame 210 is generally rectangular in shape. Preferably, when the frame 210 is attached to a volleyball net, the upper and lower frame members 214 & 220 are oriented so as to be substantially horizontal to the floor or ground surface of the volleyball court, and the first and second side frame members 216 & 218 are oriented so as to be substantially vertical to the floor or ground surface of the volleyball court. A generally vertical support member 222 & 224 may extend upwardly from each end of the upper frame member 214. The support members 222 & 224 may each include an upper end 226 & 228 having a pedestal or cup 230 & 232 for supporting a volleyball 234 & 236 above the volleyball net. The attachment device 212 may comprise a belt which may be wrapped around the frame 210 and a volleyball net to removably attach the training device 200 to the net.

As shown in FIG. 2, a generally L-shaped corner member 238 & 240 may join end 242 & 244 of the lower frame member 220 to a lower end 246 & 248 of each side frame members 216 & 218. A generally T-shaped connecting member 250 & 252 may join each end 254 & 256 of the upper frame member 214 to an upper end 258 & 260 of each of the side frame members 216 & 218. Each connecting members 250 & 252 may also join a lower end 262 & 264 of each support member 222 & 224 to an end 254 & 256 of the upper frame member 214 and an upper end 258 & 260 of each side frame members 216 & 218. Preferably, the frame members 214, 216, 218 & 220, support members 222 & 224, corner members 238 & 240, and connecting members 250 & 252 may be made of ¾-inch diameter polyvinyl chloride (PVC) pipe or tubing attached together by an adhesive or fasteners such as screws, bolts, friction or interference fit, or the like. Alternatively, the entire frame 210 and support member 222 & 224 assembly may be of a unitary construction and may be formed of metal, plastic, composite, wood, or the like.

Although the present invention is not restricted to specific dimensions, it is intended that the training devices 100 & 200 shown in FIGS. 1 and 2 will be attachable to a volleyball net conforming with the standards which are generally used or prescribed by the rules of the sport of volleyball. For example, the frame of the training device may be approximately 36 to 39 inches high to correspond to the heights of regulation volleyball nets. Each device preferably positions a volleyball approximately 11 inches above the top of the net to simulate the approximate height of a volleyball being hit or spiked by an attacker. However, in some instances the volleyball may be positioned at an increased or decreased height above the top of the net to, for example, facilitate training volleyball players of diverse skill levels and athletic ability. Further, it is possible to make the height at which the volleyball is placed above the net adjustable by providing a telescoping support member having a variable length.

Figure 3:
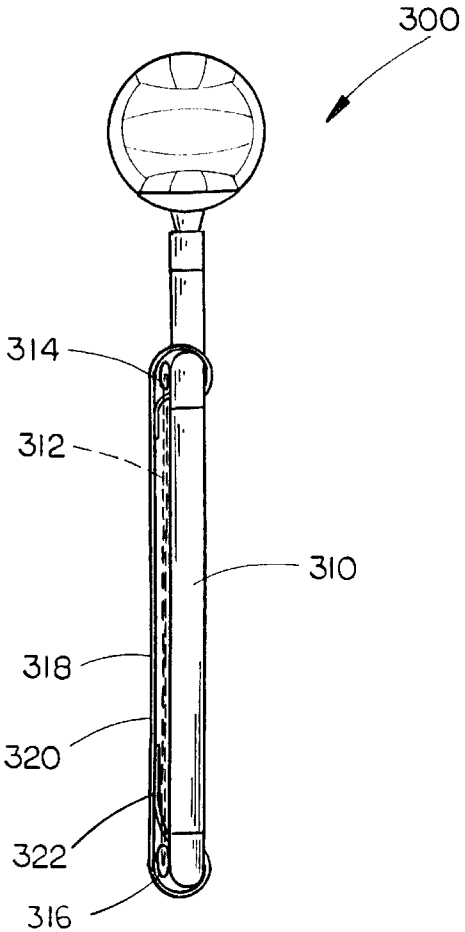
FIG. 3 is a side elevational view illustrating the attachment of a training device, as shown in FIGS. 1 and 2, to a volleyball net.

Turning now to FIG. 3, attachment of the training device to a volleyball net is illustrated. The frame 310 of the training device 300 is preferably the same height as a regulation volleyball net 312 so that it may be attached to the net's upper cable 314 and lower cord 316. In this manner, a secure, stable attachment may be provided. Each attachment device 318 preferably comprises a belt 320 having an upper end attached to the frame and a lower end having a reusable hook-and-loop fastener material closure 322. Preferably, to secure the training device 300 to the volleyball net 312, the frame 310 is placed against the net 312 while the belt 320 is placed over the upper cable 314 and beneath the lower cord 316 of the volleyball net 312. The lower end of the belt 320 may then be wrapped around the lower frame member of the frame 310 and secured to itself via the hook-and-loop fastener material closure 322. Alternately, the belt may be wrapped around the entire outer periphery of the frame 310 and volleyball net 312 (see FIG. 2). Further, although a belt 320 having a hook-and-loop fastener material closure 322 is disclosed herein as the preferred means of attachment, the frame 310 may be attached to the volleyball net via other common attachment means including, for example, ropes, belts having snaps or buckles, or clips.

Figure 4:
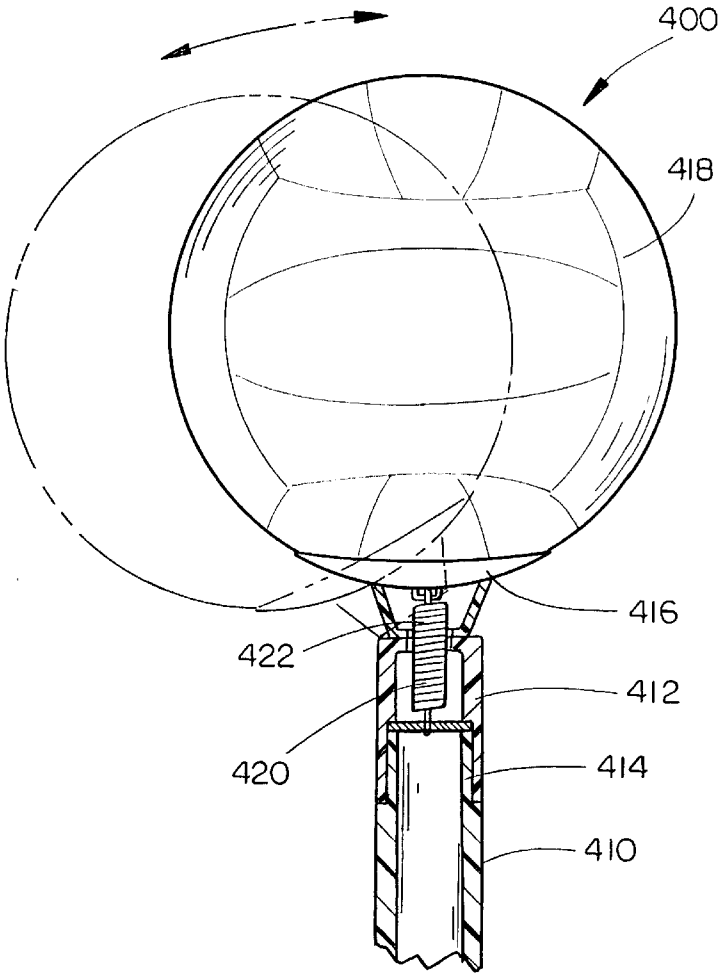
FIG. 4 is a partial cross-sectional side elevational view illustrating the support and volleyball of a training device, as shown in FIGS. 1 and 2.

Referring now to FIG. 4, the support and volleyball assembly of the training devices shown in FIGS. 1 and 2 is depicted. The support and volleyball assembly 400 includes a support member 410 having a cap 412 at its upper end 414. The cap 412 supports a pedestal or cup assembly 416 in which the volleyball 418 is secured. Preferably, the cup assembly 416 is free to rotate or pivot an any direction about a horizontal axis.

During use, a volleyball player may strike the volleyball 418 during a blocking or tipping exercise causing volleyball 418 and cup assembly 416 to pivot or rotate from a substantially upright position (shown in solid lines) wherein the volleyball 418 rests on and is supported by the upper end 414 of the support 410 to a displaced position (shown in phantom lines) wherein the volleyball is at an angle to the support 410. A return mechanism 420 may be provided for returning the volleyball from the displaced position to the substantially upright position. Preferably, the return mechanism 420 includes a spring 422 mounted within the cap 412 at the upper end 414 of the support 410. The spring 422 may, for example, be attached between the volleyball 418 and cap 412 so that when the volleyball 418 is displaced, the spring 422 causes the volleyball 418 to be returned to its upright position wherein it may be blocked or tipped again.

Figure 5:
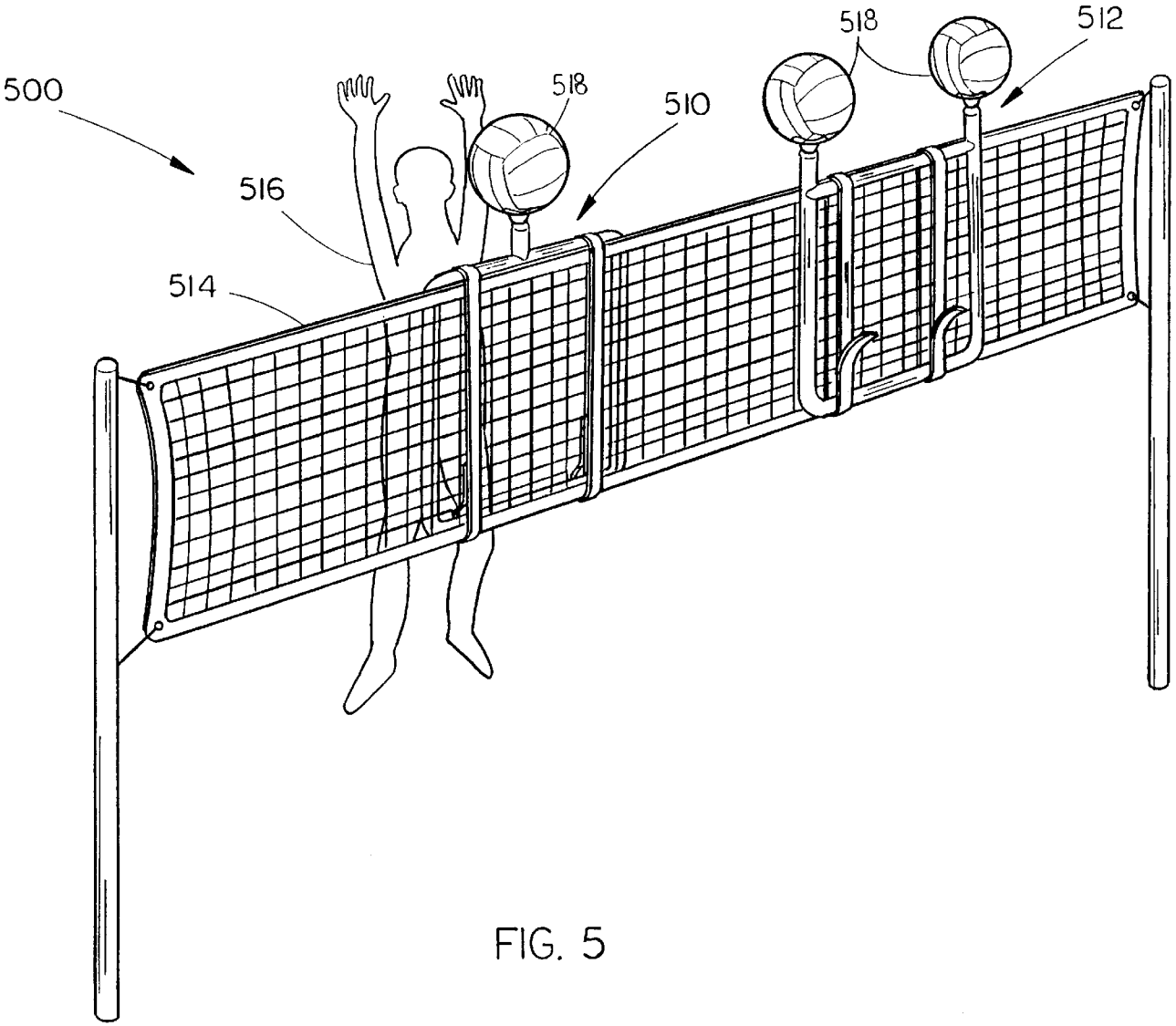
FIG. 5 is an isometric view depicting the attachment of the training devices of the present invention to a volleyball net wherein the devices are used in the training of a volleyball player to target block and tip a volleyball at the net.

Turning now to FIG. 5, use of the training devices shown in FIGS. 1 and 2 is shown. A single training device 510, as shown in FIG. 1, and a double training device 512, as shown in FIG. 2, may be attached at any point along the volleyball net 514 of the net system 500. Preferably, the training devices 510 & 512 may be used in numerous exercises or drills for training volleyball players 516 to target block and tip a volleyball at the net 514. For example, the single training device 510 may be used in a drill for training players to perform a single block against an opposing team's attacker or to teach a setter to tip a volleyball at the net 514. Similarly, the double training device 512 may be used separately or in conjunction with the single training device 510 for training players to perform a double block. Preferably, each volleyball 518 may be attached to its respective training device 510 & 512. In this manner, the need for a coach or another player to toss a volleyball to the blocking or tipping player, or to chase a blocked or tipped volleyball during a blocking or tipping drill is eliminated.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The forms herein before described being merely explanatory embodiments thereof, it is the intention of the following claims to encompass and include such changes.

What is claimed is:

1. A volleyball player training device comprising:

a frame attachable to a volleyball net;

a generally vertical support extending upwardly from said frame, said support having an upper end including a pedestal for pivotally supporting a volleyball above said support;

a volleyball pivotally supported by said pedestal;

a return mechanism mounted to the upper end of said support below said pedestal for returning said volleyball from the displaced position to the substantially upright position; and an attachment assembly mounted to said frame for removably attaching said frame to the volleyball net wherein said volleyball is supported above the volleyball net by said support.

2. The volleyball player training device according to claim 1, wherein the frame comprises a perimeter having two substantially vertical side frame members, a substantially horizontal upper frame member, and a substantially horizontal lower frame member.

3. The volleyball player training device according to claim 2, wherein the support extends upwardly from said substantially horizontal upper frame member.

4. The volleyball player training device according to claim 1, wherein said frame and said support are formed from polyvinyl chloride (PVC) pipe.

5. The volleyball training device according to claim 1, wherein said volleyball may pivot between a substantially upright position supported by the upper end of said support and a displaced position at an angle to said support.

6. The volleyball player training device according to claim 4, wherein said return mechanism comprises a spring.

7. The volleyball player training device according to claim 1, wherein said attachment assembly comprises a belt having a reusable hook-and-loop fastener material closure.

8. A volleyball player training device comprising:

a frame attachable to a volleyball net;

a volleyball;

a generally vertical support extending upwardly from said frame, said support having an upper end including a pedestal for pivotally supporting said volleyball above said support so that said volleyball may pivot between a substantially upright position supported by the upper end of said support and a displaced position at an angle to said support;

a return mechanism mounted to the upper end of said support below said pedestal for returning said volleyball from the displaced position to the substantially upright position; and an attachment assembly mounted to said frame for removably attaching said frame to the volleyball net wherein said volleyball is supported above the volleyball net by said support.

9. The volleyball player training device according to claim 8, wherein the periphery of said frame comprises two substantially vertical side frame members, a substantially horizontal upper frame member, and a substantially horizontal lower frame member.

10. The volleyball player training device according to claim 9, wherein the support extends upwardly from said substantially horizontal upper frame member.

11. The volleyball player training device according to claim 8, wherein said frame and support are formed from polyvinyl chloride (PVC) pipe.

12. The volleyball player training device according to claim 8, wherein said return mechanism comprises a spring.

13. The volleyball player training device according to claim 9, wherein said attachment assembly comprises a belt having a reusable hook-and-loop fastener material closure.

14. A volleyball player training device, comprising:

a frame suitable for being attached to a volleyball net;

at least one support extending upwardly from said frame, said support having an upper end including a pedestal for pivotally supporting a volleyball above said support; and a return mechanism mounted to the upper end of said support below said pedestal for returning said volleyball front the displaced position to the substantially upright position;

wherein the volleyball may pivot between a substantially upright position supported by the upper end of said support and a displaced position at an angle to said support.

15. The volleyball player training device according to claim 14, wherein said return mechanism comprises a spring coupled to and extending between said support and the volleyball.

16. The volleyball player training device according to claim 14, further comprising an attachment assembly mounted to said frame for removably attaching said frame to the volleyball net wherein the volleyball may be supported above the volleyball net by said support.

17. The volleyball player training device according to claim 16, wherein said attachment assembly comprises a belt having a reusable hook-and-loop fastener material closure.

* * * * *